United States Patent [19]

Kashio

[11] 4,132,060

[45] Jan. 2, 1979

[54] ELECTRONIC TIMEPIECE

[75] Inventor: Toshio Kashio, Tokyo, Japan

[73] Assignee: Casio Computer Co., Ltd., Tokyo, Japan

[21] Appl. No.: 809,710

[22] Filed: Jun. 24, 1977

[30] Foreign Application Priority Data

Jun. 24, 1976 [JP] Japan ..... 51-73826
Jun. 24, 1976 [JP] Japan ..... 51-73827

[51] Int. Cl.[2] ..... G04B 27/00
[52] U.S. Cl. ..... 58/23 R; 58/85.5
[58] Field of Search ..... 58/23 R, 85.5; 235/92 T; 364/718, 569

[56] References Cited

U.S. PATENT DOCUMENTS

| | | | |
|---|---|---|---|
| 3,798,428 | 3/1974 | Izawa | 235/168 |
| 3,812,669 | 5/1974 | Wiget | 58/23 R |
| 4,045,952 | 9/1977 | Kashio | 58/23 R |
| 4,078,375 | 3/1978 | Kashio | 58/23 R |

*Primary Examiner*—Robert K. Schaefer
*Assistant Examiner*—Jit W. Miska
*Attorney, Agent, or Firm*—Flynn & Frishauf

[57] ABSTRACT

An electronic timepiece uses a dynamic type shift register, as a time count circuit, which has a plurality of memory sections corresponding to an equal number of time count units and a cycle number memory section arranged such that it is preceded by said plurality of memory sections. An adder and shift memory unit are serially connected to the shift register to provide a shift circulation circuit and the shift circulation is effected by an oscillation signal from a reference oscillator. The adder adds [1] to the contents of the cycle number memory section for each data shift cycle of the shift register. Each time the count value of the cycle number memory section reaches a predetermined cycle number, the count value of a smallest time unit is counted one step. In this way, a carry is propagated to the subsequent large time unit memory sections according to the data shift circulation cycle of the shift register. A memory circuit is also provided which preliminarily stores a correction value corresponding to an error occuring between the oscillation frequency of the reference oscillator as generated per unit time and the standard oscillation frequency which drives the shift circulation circuit. Upon receipt of a correction timing signal the memory circuit has its correction value substracted at a rate of one circulation cycle per minute, thereby to correct such an error. The correction value indicates a total number of subtractive circulation cycle per hour.

6 Claims, 10 Drawing Figures

ELECTRONIC TIMEPIECE

BACKGROUND OF THE INVENTION

This invention relates to an electronic timepiece in which a time count operation is effected using a shift register and an error arising from the oscillation frequency of a reference oscillator is corrected by a control system of the shift register.

An electronic timepiece is conventionally known in which a time count operation is effected based on an oscillation signal from the reference oscillator which is constituted of a crystal oscillator of stable oscillation. A digital display type electronic timepiece of this variety is also proposed in which a time display is effected in a digital mode. In particular, a digital display type electronic timepiece becomes known in which a display is effected by an electronic signal which is derived from a liquid crystal, LED etc.

In such electronic timepiece, the oscillation signal from the reference oscillator is properly frequency divided into time count signals corresponding to time display units such as "hours", "minutes", "seconds" etc, and a time display is made by controlling the numerals display function corresponding to each time unit by the time count signal. Such electronic timepiece has a great advantage in that a correct time count operation is always effected by stably setting the oscillation frequency of the reference oscillator at all times. Although the stabilization of the oscillation frequency can be attained using, for example, a crystal oscillator, it is further necessary that in order to continue a correct time count operation the oscillation frequency of the reference oscillator be set to a standard frequency determined in connection with a time count circuit section. That is, it is necessary to correct an error as produced between the standard frequency and the oscillation frequency of the reference oscillator. Such a reference oscillator is equipped with a fine adjustment mechanism for adjusting the oscillation frequency by a trimmer capacitor etc. However, providing such a trimmer adjustment mechanism with respect to the reference oscillator and adjusting it manually will involve a great increase in an amount of task during the assembly and adjustment process of the timepiece, thus imparting a very adverse effect to the operability and quantity production.

SUMMARY OF THE INVENTION

It is accordingly the object of this invention to provide an electronic timepiece in which, when a time count circuit for counting signals from a reference oscillator is constituted by a shift register, an error as caused between a standard frequency and an oscillation frequency of the reference oscillator can be corrected by effectively utilizing the shift register section without any trimmer adjustment etc. with respect to the oscillator.

According to this invention there is provided an electronic timepiece comprising a reference oscillator; shift memory means adapted to be controlled in accordance with oscillation signals from the reference oscillator and having a plurality of time count memory sections corresponding to an equal number of time count units and a cycle number memory section arranged such that it is preceded by said plurality of time count memory sections, said shift memory section being such that memory data can be sequentially shifted as a carry from the cycle number memory section toward the successive time count memory sections; means for adding [1] to the contents of the cycle number memory section for each data shift cycle of the shift memory means; means for permitting the contents of a smallest time unit memory section of said memory sections to be counted one step when the count value of said cycle number memory section reaches a predetermined cycle number and for permitting a carry to the subsequent large time unit memory sections; means for writing a correction value x corresponding to an error per a predetermined time unit as induced between a standard oscillation frequency and an oscillation frequency of said reference oscillator; setting means for setting x number of correction timings into which said predetermined unit time is divided; and means for correcting said predetermined cycle number counted in the cycle number memory section for each timing set by said setting means.

According to this invention there is provided an electronic timepiece in which an accurate time count operation is effected without finely adjusting the oscillation frequency of the reference oscillator by a trimmer capacitor etc and thus an adjustment operation of the oscillator can be much simplified, assuring the enhanced performance and enhanced productivity.

BRIEF DESCRIPTION OF THE DRAWINGS

This invention will be further described by way of example by referring to the accompanying drawings in which.

DETAILED DESCRIPTION OF THE PREFERRED EMBODIMENTS

One embodiment of this invention will be explained below by reference to the accompanying drawings.

Figure 1:
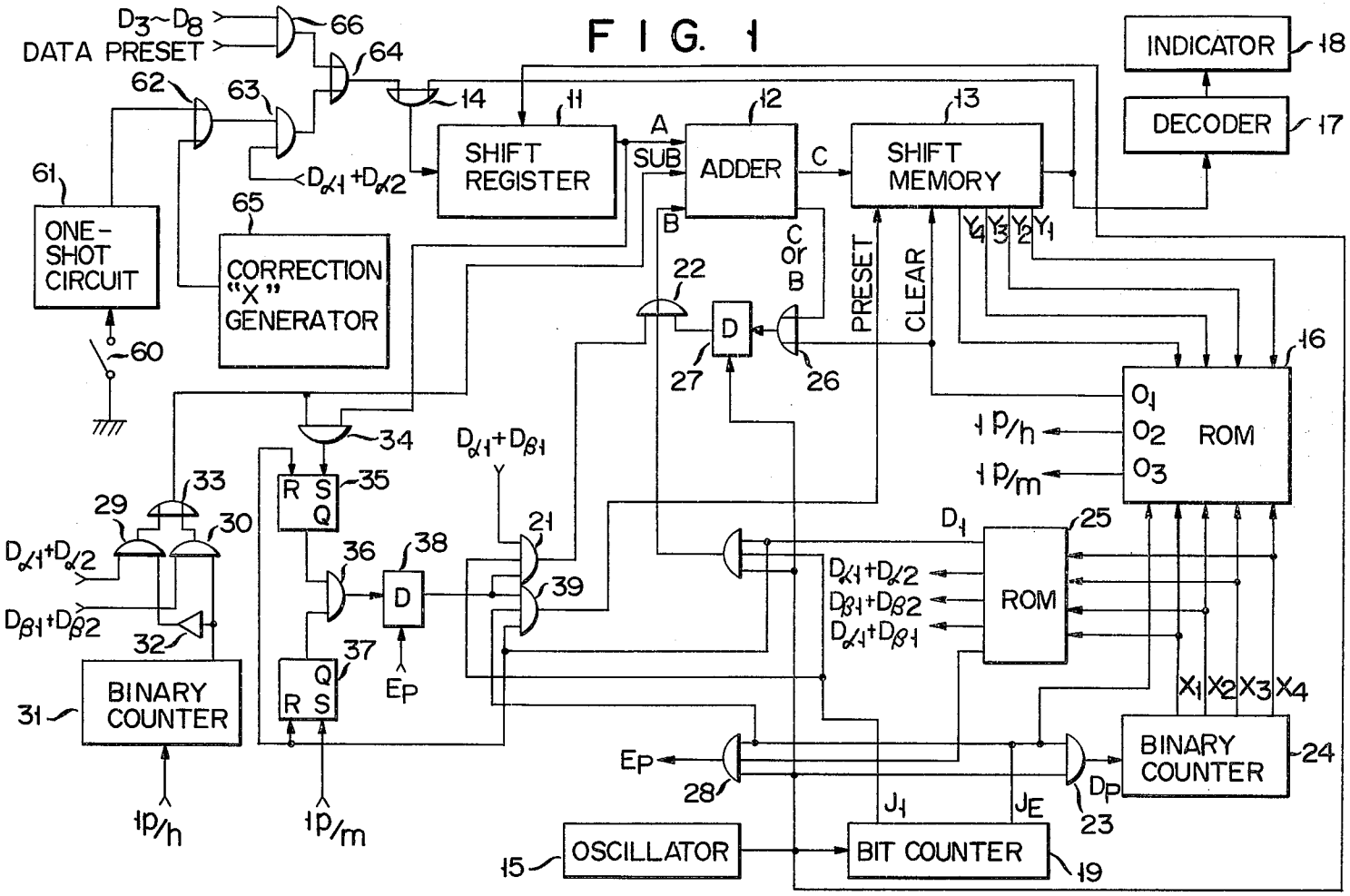
FIG. 1 a block diagram showing one embodiment of the invention.
Figure 2:
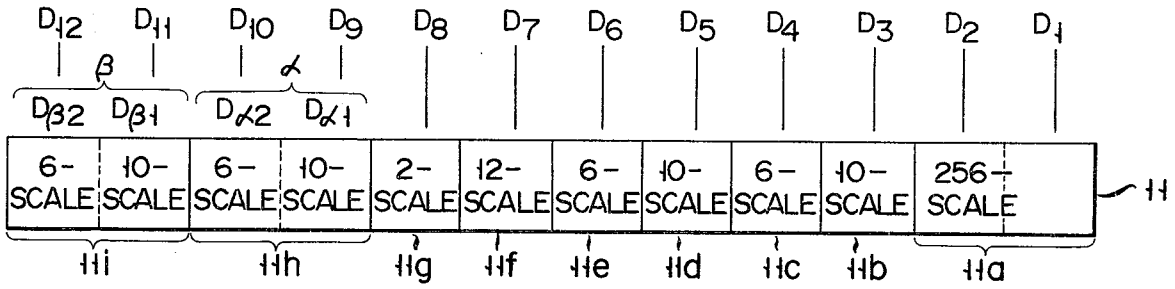
FIG. 2 is a view showing the memory contents of the respective memory sections of a shift register in FIG. 1.
Figure 3:
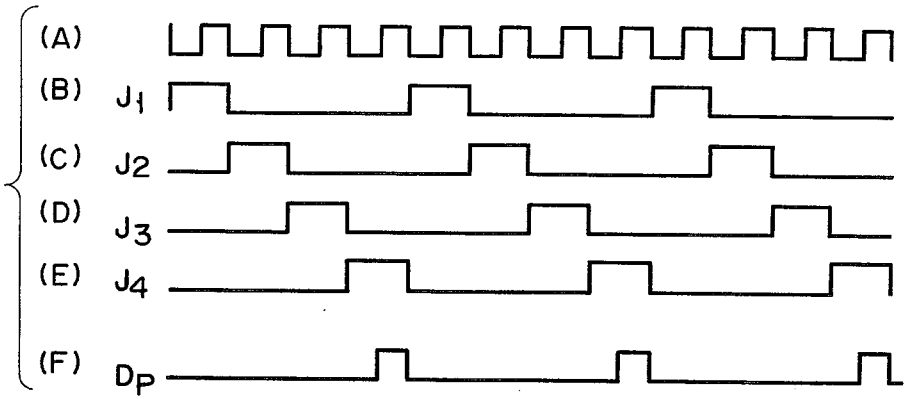
FIG. 3 shows an output waveform from a bit count in FIG. 1.
Figure 4:
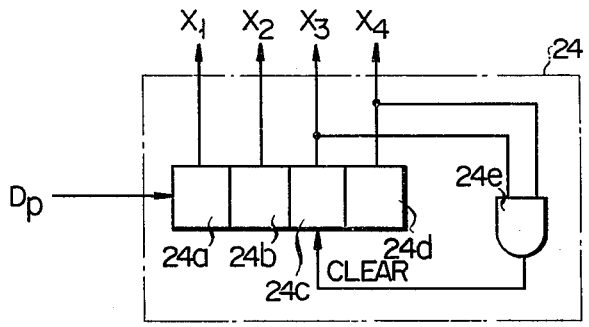
FIG. 4 is a detailed view showing a binary counter in FIG. 1.
Figure 5:
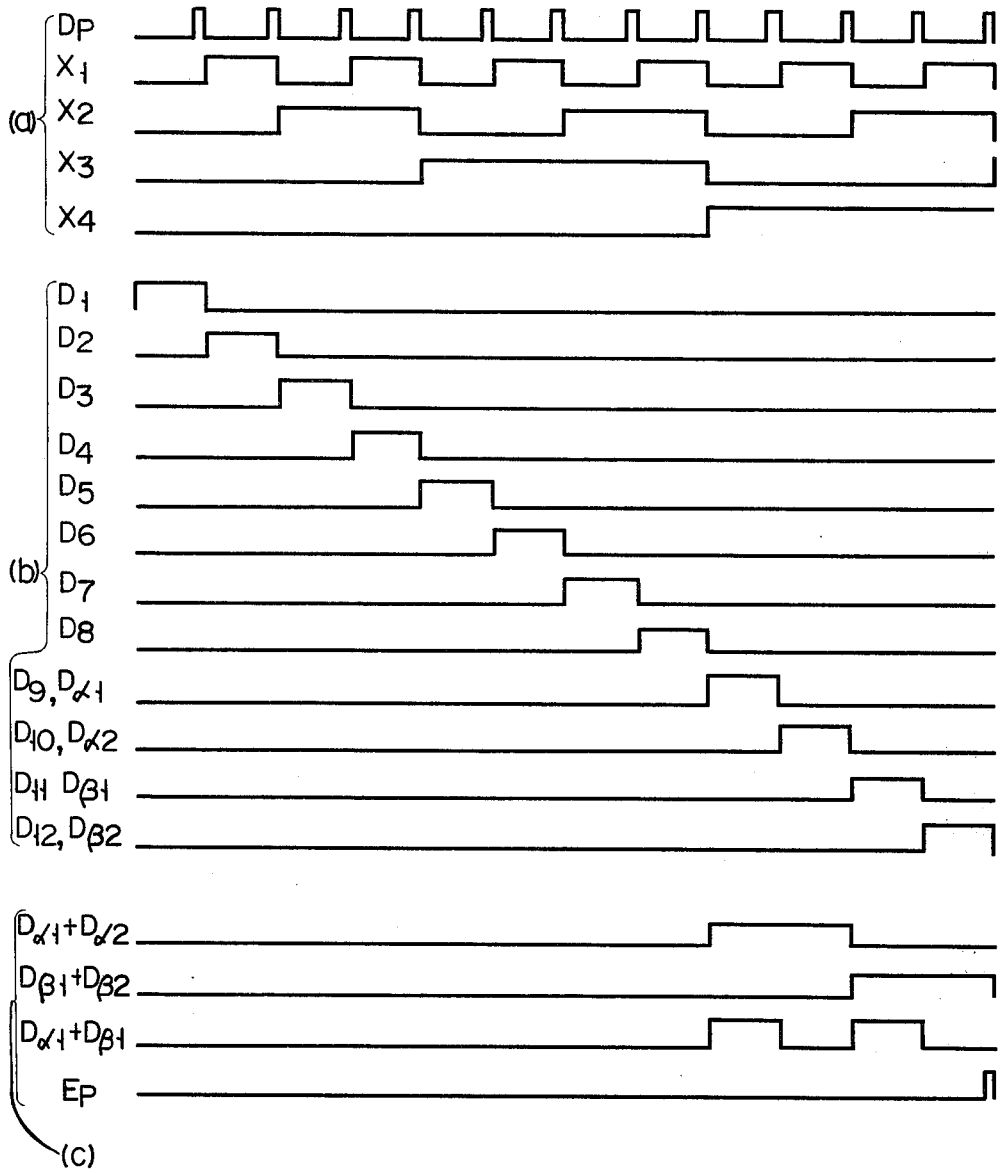
FIG. 5 shows the output waveform of the binary counter and the output waveform of count timing instruction signals for driving the respective memory sections of the shift register.
Figure 6:
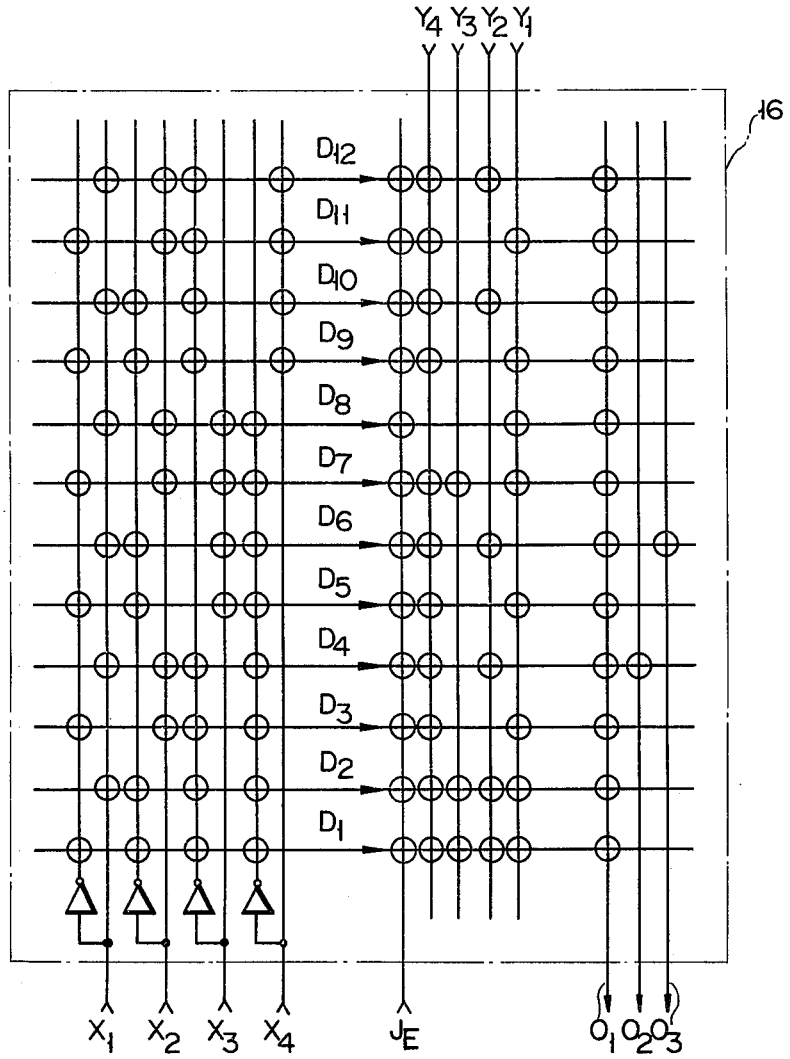
FIG. 6 is a detailed view showing a RDM 16 in FIG. 1.

In FIG. 1 is shown a shift register 11 which constructs a time count circuit for obtaining a time count data. The shift register 11 may include a variety of function circuits, for example, a timer, a global watch, an alarm etc. as necessity arises. To the shift register 11 is serially connected an adder 12 and a 4 bit shift memory unit 13 including, for example, a correction circuit. The output of the shift memory unit 13 is fed back to the input of the shift register 11 through an OR circuit 14, thereby providing a shift circulation circuit. The shift data circulation is dynamically effected by supplying to the shift register 11 and shift memory unit 13 a clock signal which is delivered from a reference oscillator 15, such as a crystal oscillator, adapted to effect a stable oscillation operation. A frequency division circuit may be provided at a succeeding stage of the reference oscillator so that the output of the frequency division circuit can be used as a shift instruction signal to the shift circulation circuit. As shown in FIG. 2 the shift register 11 includes a memory section 11*a* for counting the number of shift data circulation cycles of the shift circulation circuit and storing a corresponding data, a memory section 11*b* for storing a time data in units of "seconds", a memory section 11*c* for storing a time data in units of "10-seconds", a memory section 11*d* for storing a time data in units of "minutes", a memory section 11*e* for storing a time data in units of "10-minutes", a memory section 11*f* for storing a time data in units of "hours" and a memory section 11*g* for storing a time data of a.m. and p.m. In this embodiment, two correction value storing sections 11*h* and 11*i* are provided ahead of the memory section 11*g*. The memory-section 11*a* in the shift register 11 is constructed of a 4+4-bit configuration, each 4-bit corresponding to one digit position, to permit 256 counts to be made. As a result, the bit configuration of the memory section 11*a* permits 256 ($=2^8$) shift data circulation cycles of the shift register 11, for example, for a one second time period, considered from a relation of the oscillation frequency of the reference oscillator 15 to the number of bit numbers in the shift circulation circuit including the shift register 11. When the memory section 11*a* counts [256], a carry signal is delivered to the memory section 11*b* where "second" data are counted on a decimal basis. The memory section 11*c* is counted on a scale-of-6 basis; the memory section 11*d*, on a scale-of-10 basis; the memory section 11*e*, on a scale-of-6 basis; and the memory section, on a scale-of-12 basis. The memory section 11*g* permits its contents to be counted two steps. The respective memory sections may be constructed in a 4-bit per digit configuration since it is sufficient if count can be made up to 6, 10 or 12, inclusive, with respect to the time units of the respective memory sections, such as seconds, 10-seconds, minutes, 10-minutes, hours etc. The correction value storing sections 11*h* and 11*i*, each, can store a 4+4(=8)-bit numerical value, each 4-bit corresponding to one digit. For convenience of explanation the memory portion of the memory section 11*h* is represented by an $\alpha(D_{\alpha 1} + D_{\alpha 2})$ timing and the memory portion of the memory section 11*i* by a $\beta(D_{\beta 1} + D_{\beta 2})$ timing. The contents of the shift register 11 are passed through the adder 12 and detected, in a one digit unit, at the shift memory section 13. The output of the shift memory unit is delivered as a 4-bit ($Y_1$, $Y_2$, $Y_3$, $Y_4$) configuration to ROM 16. At the same time, the output of the shift memory unit 13 is supplied through a decoder 17 to a display unit 18. The oscillation signal of the reference oscillator 15 is counted at a bit counter 19. The bit counter 19 makes 4-bit counts to permit the data of the shift register 11 to be shifted as a 4-bit per digit configuration. That is, the respective bits of the 4-bit data of the shift register 11 are weighted in the order of $2^0$, $2^1$, $2^2$ and $2^3$. In response to the output of the reference oscillator the bit counter 19 counts the corresponding timing signals $J_1$, $J_2$, $J_3$ and $J_4$ as shown in FIGS. 3(B), 3(C), 3(D) and 3(E), respectively, and delivers the timing signals $J_1$ and $J_4$ (JE). An AND circuit 23 delivers a digit pulse signal $D_p$ each time it receives the timing signal JE from the bit counter 19 (FIG. 3(F)). A binary counter 24 has its contents counted by the digit pulse signal $D_p$ of the AND circuit 23. The binary counter 24 includes one-digit memory section 24*a*, 24*b*, 24*c* and 24*d* as shown in FIG. 4. Outputs $X_3$ and $X_4$ of the memory sections 24*c* and 24*d*, respectively, in the binary counter 24 are supplied to an AND circuit 24*e*, the output of which is supplied to the binary counter 24 for resetting. That is, the binary counter 24 is a scale-of-12 counter adapted provide 12 binary output states [0000], [1000] . . . [1101]. FIG. 5(*a*) is a time chart for showing these output states. The memory sections 24*a*, 24*b*, 24*c* and 24*d* in the binary counter 24 generates, upon the fall of the digit pulse signal $D_p$, count outputs $X_1$, $X_2$, $X_3$ and $X_4$ which is weighted in the order of [1], [2], [4] and [8], respectively. The count outputs of the binary counter 24 are fed to ROM 16 as shown in FIG. 1 and to ROM 25. ROM 16 is constructed as shown in FIG. 6. The last timing pulse JE of the BIT counter 19 is supplied to ROM 16 where it is compared with the count outputs $X_1$, $X_2$, $X_3$ and $X_4$ of the binary counter 24 to produce timing outputs $D_1$, $D_2$ . . . $D_{12}$ as shown in FIG. 5(*b*). The last timing pulse JE fed to ROM 16 is also compared with the 4-bit ($Y_1$, $Y_2$, $Y_3$, $Y_4$) data from the shift memory unit 13. The relation of the count outputs $X_1$, $X_2$, $X_3$ and $X_4$ to the digital timing outputs $D_1$, $D_2$ . . . $D_{12}$ is shown in the following table.

Table

| | $X_1$ | $X_2$ | $X_3$ | $X_4$ |
|---|---|---|---|---|
| $D_1$ | 0 | 0 | 0 | 0 |
| $D_2$ | 1 | 0 | 0 | 0 |
| $D_3$ | 0 | 1 | 0 | 0 |
| $D_4$ | 1 | 1 | 0 | 0 |
| $D_5$ | 0 | 0 | 1 | 0 |
| $D_6$ | 1 | 0 | 1 | 0 |
| $D_7$ | 0 | 1 | 1 | 0 |
| $D_8$ | 1 | 1 | 1 | 0 |
| $D_9$ | 0 | 0 | 0 | 1 |
| $D_{10}$ | 1 | 0 | 0 | 1 |
| $D_{11}$ | 0 | 1 | 0 | 1 |
| $D_{12}$ | 1 | 1 | 0 | 1 |

Figure 7:
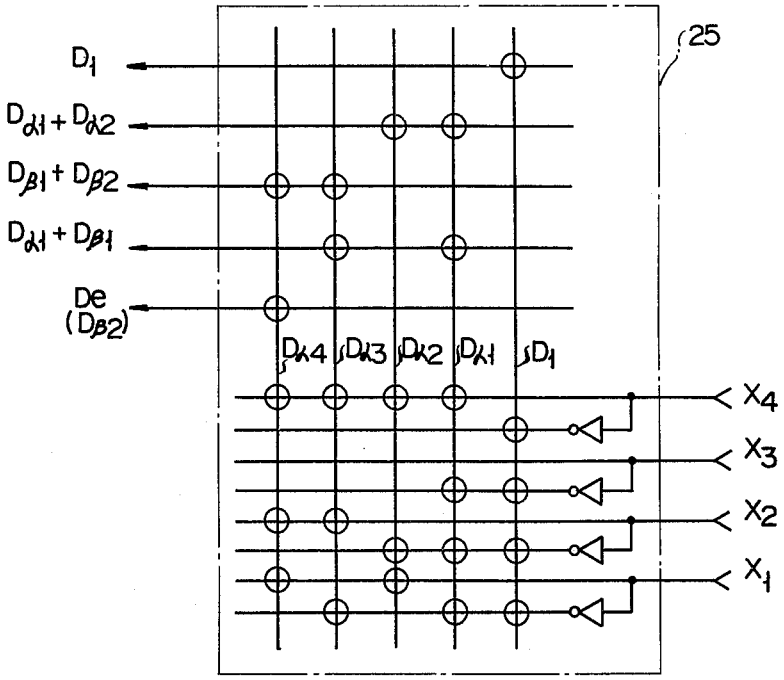
FIG. 7 is a detailed view showing a RDM 25 in FIG. 1.

Although the data of the shift register 11 has been assumed as being circulated 256($=2^8$) time for a one second time period, +1 may be added at the digit $D_1$ time to the data of the shift register 11 for each data circulation. As mentioned above, the count outputs $X_1$, $X_2$, $X_3$ and $X_4$ of the binary counter 24 are also supplied to ROM 25. As shown in FIG. 7, the output signals $X_1$, $X_2$, $X_3$ and $X_4$ are ANDed to produce timing signals $D_1$, $D_{\alpha 1}$, $D_{\alpha 2}$, $D_{\beta 1}$, and $D_{\beta 2}$ which are in turn ORed to generate timing signals $D_1$, $D_{\alpha 1}+D_{\alpha 2}$, $D_{\alpha 1}+D_{\beta 1}$, $D\beta_1+D\beta_2$ and $D\beta_2$. When the output signals $X_1$, $X_2$, $X_3$ and $X_4$ are 0, 0, 0 and 0, respectively, the timing signal $D_1$ is generated from ROM 25. The digit timing output $D_1$ is inputted to an AND circuit 20 from which it is generated at the time when the head bit output $J_1$ is generated. The output of the AND circuit 20 is supplied as a $\beta$ signal i.e. a+1 add instruction to the adder 12 through an OR circuit 22. The adder 12 adds +1 to the data of the shift register 11 for each one cycle and ROM 16 generates a clear instruction signal when it confirms that the memory section 11*a* in the shift memory unit 13 has made a 256/256 count. The clear instruction signal of ROM 16 is supplied to the shift memory unit 13 to cause the contents of the memory section 11*a* in the shift memory unit 13 to be cleared. The clear instruction signal of ROM 16 is also supplied through an OR circuit 22 to a delay circuit 27 adapted to be driven by an oscillation signal from the reference oscillator 15. The clear instruction signal, after delayed at the delay circuit 27 by one bit delay time, is supplied as the $\beta$ signal to the adder 12 through the OR circuit 22. [1] is added by an output signal C from the adder 12 to the data of the memory section 11*b* in the shift register 11 to permit it to count seconds upon which the time count operation is based. The seconds counting is so continued and at the time when a digit timing signal $D_3$ is generated (i.e. when the outputs $X_1$, $X_2$, $X_3$ and $X_4$ of the binary counter 24 are 0, 1, 0 and 0, respectively and the memory section 11*b* in the shift register 11 counts 10 seconds), the 4-bit data (1,0,0,1) is inputted as a code input ($Y_1$, $Y_2$, $Y_3$, $Y_4$) to ROM 16. At this time, an input is generated from an output terminal $0_1$ of ROM 16. The output is supplied to the shift memory unit 13 where the contents of the memory section 11*b* is cleared. The output of the output terminal $0_1$ is supplied through the OR circuit 26, delay circuit 27 and OR circuit 22 to the adder 12 to permit +1 to be added to the data of the memory section 11*c* in the shift register 11. In this way, a carry is propagated to the subsequent memory section 11*d*, 11*e*, 11*f* and 11*g* in th shift memory 11 in accordance with the digit timing signals $D_4$, $D_5$, $D_6$, $D_7$ and $D_8$, respectively.

If the oscillation frequency of the reference oscillator 15 coincides with a standard frequency determined by the circulation circuit including the shift register 11, the above-mentioned time count operation is accurately effected. In actual practice, however, the oscillation frequency of the reference oscillator is not always constant and it often involves an error with respect to the standard frequency. In order to correct such an error, a carry generation requirement which is a carry instruction from the memory section 11*a* to the memory section 11*b* in the shift register 11 is compulsorily varied without resort to an adjusting means such as a conventional trimmer capacitor, thus assuring an eventual time counting accuracy. Stated in more detail, where the oscillation frequency of the oscillation 15 is deviated to a lesser extent than the standard frequency, the number of circulation cycles, 256, which is the carry generation requirement is so controlled that it is decreased. If in this case the amendment of the above-mentioned carry generation requirement is collectively effected at the interval of, for example, one hour, the time counting at this time becomes unnatural. For this reason, the number of circulation cycles, 256, corresponding to one second is subtracted, for example, at a rate of one cycle per minute over one hour. Since, in this case, the data of the shift register 11 is assumed to be circulated at the rate of $2^8(=256)$ cycles per second, it is circulated $2^8\times 60$ times for one minute. Thus, one subtractive cycle per minute means that the number of circulation circles involved for a minute is selected to be $$(2^8\times 60)-1.$$

Thus, the data of the shift register is circulated at a cycle of $[\{(2^8\times 60)-1\}x+(2^8\times 60)\ (60-x)]$ per hour.

Where x means that the number of subtractive cycles. Since one hour includes 60 minutes, $60\geqq x\geqq 0$. Now assume that $x=1$. Since in this case one cycle of the shift register 11 is $1/2^8$ second, the time corresponding to one cycle of the shift register is subtracted over one hour so as to effect correction. The amount of correction will be $$24x1/2^8 = 24\times 0.0039062 = 0.09375 \text{ second/day} = 2.8125 \text{ seconds/month.}$$

If $x=60$, it follow that $$24x1/2^8\times 60 = 5.53125 \text{ seconds/day} = 165.9375 \text{ seconds/month}$$

That is, a time correction of about 2.8 to 166 seconds is effected over one month. If an oscillator is of an ordinary type, an error of the oscillation frequency is very small i.e. falls well within this range. In this embodiment an error of the reference oscillator 15 is beforehand measured and a corresponding value "x" is stored in the memory sections 11*h* or 11*i* through the OR circuit 14. At this time, a time data etc. to be written in the other memory section is also stored in the memory section 11*h* or 11*i*, as required. The correction value "x" is written into the shift register 11 as follows.

When a power supply switch 60 is operated, a one-shot circuit 61 is energized to deliver an output to an AND circuit 63 through an OR circuit 62 (FIG. 1). The AND circuit 63 delivers upon receipt of the digit timing signal $D_{\alpha 1}+D_{\alpha 2}$ an output to the memory section 11*h* in the shift register 11 through OR circuit 64 and 14. Thus, the correction value "x" is written into the memory section 11*h* or 11*i* in the shift register 11. The same object can also be attained by using in addition to the one-shot circuit 61 a correction value "x" generator 65 operated, for example, by a Smidt circuit adapted to detect a "power ON" when a power supply is ON. In this case, the correction value "x" is unconditionally generated from the correction value "x" generator 65 by turning a power supply ON. The output is likewise delivered through the OR circuit 62, AND circuit 63, and OR circuits 64 and 14 to the memory section 11*h* or 11*i* in the shift register 11.

Where a time setting data has been stored in the circulation circuit including the shift register 11, the timing outputs $D_3 \ldots D_8$ corresponding to 10-seconds, minutes, 10-minutes, hours and AM/PM, respectively, is inputted to the AND circuit 66. The output of the AND circuit 14 can be inputted through the OR circuit 64 and 14 to the corresponding memory section in the shift register 11. Suppose, for example, that the output of a binary counter 31 becomes zero in such an initial state that the value "x" is written in the memory section 11*h* in the shift register 11. If in this state the above-mentioned time count operation is effected, timing signals $D_{\alpha 1}+D_{\alpha 2}$ and $D_{\beta 1}+D_{\beta 2}$, as shown in FIG. 5, which designate $\alpha$ and $\beta$ digit positions of the memory sections 11*h* and 11*i* in the shift register 11 are generated from ROM 25 for each shift circulation cycle of the shift register 11. Since at this time the output of the binary counter 31 is being set to zero, an inverter 32 delivers an output to an AND circuit 29. The output of the AND circuit 29 is, after passed through the OR circuit 33, supplied as a substraction instruction to the adder 12 at the timing $(Q_{\alpha 1}+Q_{\alpha 2})$ in which the correction value "x" is delivered as an output A from the shift register. So long as the value "x" from the shift register 11 is present, an AND circuit 34 generates an output to cause a flip-flop circuit 35 to be set. A flip-flop circuit 37 is set by a signal which is generated for each minute from an output terminal $O_3$ (FIG. 6) of ROM 16. With the flip-flop circuits 35 and 37 both in the set state an output is generated from an AND circuit 36. The output of the AND circuit 36 is supplied to a delay circuit 38 and the delay circuit 38 generates an output, during one cycle, upon receipt of an end pulse $E_p$ which is generated from the AND circuit 28 at the JE timing of the last digit timing signal $D_{12}$.

The output of the AND circuit 36 is supplied to AND circuits 21 and 39 for a one cycle period. In consequence, a signal $\beta$ is applied from the AND circuit 21 through the OR circuit 22 to the adder 12 at the timing corresponding to the first bit $J_1$ of the timing signal $D_{\alpha 1}$ which is generated during the subsequent shift cycle of the shift register 11. Since, as mentioned above, the subtraction instruction SuB is supplied through the AND circuit 29 and OR circuit 33 to the adder 12, the adder 12 subtracts "1" from a numerical data stored in the digit position $D_{\alpha 1}$ of the memory section $\alpha$ in the shift register. By this subtractive operation the flip-flop circuits 35 and 37 are reset upon receipt of the digit timing pulse $D_1$ which is generated from ROM 25.

The AND circuit 21 generates an output even at the timing in which the other memory section $\beta$ is designated. Since at this time the binary counter 31 generates no output, no output appears from an AND circuit 30 and thus no output appears from the OR circuit 33. In consequence, the adder 12 and adds "1" to the data of the memory section $\beta$ in the shift register 11. That is, the adder 12 subtracts "1" from the numerical data $\alpha$ of the memory section 11*h* in the shifted register 11 and adds "1" to the data of the memory section 11*i* in the shift register 11. The detailed arrangement of the adder 12 is shown in FIG. 8.

Figure 8:
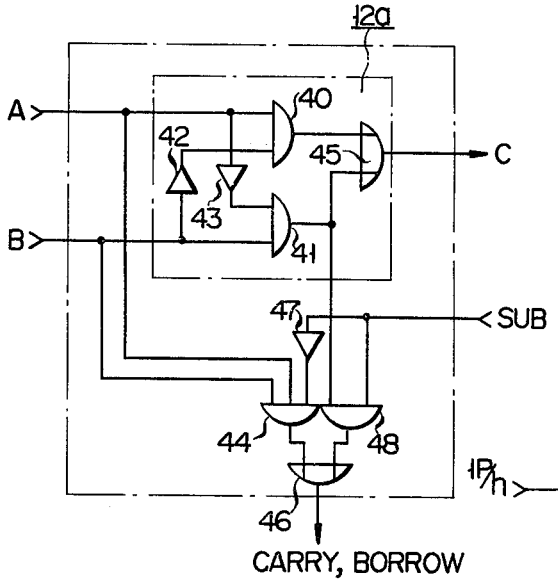
FIG. 8 is a detailed view showing an adder in FIG. 1.

In FIG. 8 an exclusive logical sum circuit comprises an AND circuit 40 to one gate of which the shift output A is supplied from the shift register 11, an AND circuit 41 to one gate of which the output $\beta$ is supplied from the OR circuit 22, inverters 42 and 43 connected to the AND circuits 40 and 41, respectively, and an OR circuit to which the outputs of the AND circuits 40 and 41 are coupled.

Suppose that the binary coded signal is at the zero level. As mentioned above, the AND circuit 20 generates an output upon receipt of the timing signal $D_1$ which is sent from ROM 25. When the output of the AND circuit 20 is applied as a signal $\beta$ to the AND circuit 41 in the exclusive logical sum circuit through the OR circuit 22, the output of the AND circuit 41 is passed through the OR circuit 45 and extracted as the output C for the data shift circulation of the shift circulation circuit. Now suppose that the output A is circulated as the binary coded signal "1" in the shift circulation circuit and at this state the output $\beta$ is inputted as the binary coded signal "1" to the adder 12. At this case, the outputs A and B are both gated at an AND circuit 44, but since at this time no SuB instruction is present an output is supplied from an inverter 46 to the AND circuit 44. The output of the AND circuit 44 is supplied as a carry signal to an OR circuit 46. The carry signal of the OR circuit 46 is supplied as an add instruction signal $\beta$ to the adder 12 through the OR circuit 26, delay circuit 27 and OR circuit 22. Where, on the other hand, the binary coded signal "0" as an A input is subtracted from the binary coded signal "1", the output of the AND circuit 41 is supplied to an AND circuit 48. When at this state the SuB instruction input is present as a subtraction instruction, the output of the AND circuit 48 is extracted, as a borrow signal, through the OR circuit 46. The output of the delay circuit 38 imparts a gate instruction to the AND circuit 39 and the AND circuit 39 generates an output signal at the $D_1$ signal timing and upon receipt of the bit-JE signal. The output of the AND circuit 39 is applied to the shift register 13 to cause the latter to be preset.

Figure 9:
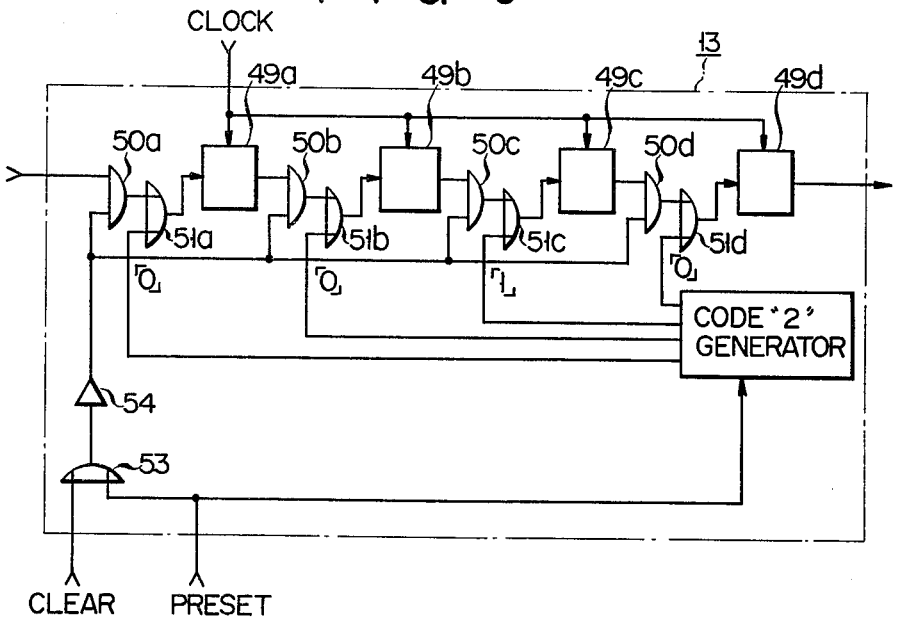
FIG. 9 is a detailed view showing a shift memory unit in FIG. 1.

The detailed arrangement of the shift memory 13 is shown in FIG. 9. The shift memory unit 13 includes 1-bit memory elements 49*a* to 49*d* driven by the oscillation clock signal from the reference oscillator 15. Input signals of the memory elements 49*a* . . . 49*d* are received respectively through AND circuits 50*a* . . . 50*d* and OR circuits 51*a* . . . 51*d*. A 4-bit code signal [0010] is supplied to the OR circuits 51*a* . . . 51*d* from a code generator 52 adapted to generate a numerical value "2" in the form of a code. A clear instruction and preset instruction are supplied to an OR circuit 53 from outside. The output of the OR circuit 53 is passed through an inverter 54 and then supplied as a gate signal to the AND circuits 50*a* . . . 50*d*. The preset instruction is supplied as a code generation instruction to the code generator 52.

When the clear instruction is supplied from the output $O_1$ of ROM 16 to the shift memory unit 13, the gates of the AND circuits 50*a* . . . 50*d* are closed due to the presence of the inverter 54, [0] is delivered to all the memory elements 49*a* . . . 49*d*. When the preset instruction is supplied to the shift memory unit 13, the gates of the AND circuits 50*a* . . . 50*d* are closed to permit the memory elements 49*a* . . . 49*d* to be preset to a code data from the code generator 52 which corresponds to the numerical value "2". In the case of such instructions the data from the adder 12 is shifted through the shift memory unit 13.

A 1p/1m signal is generated from ROM 16 in synchronism with a step count made in units of minutes. The flip-flop circuit 37 is set by the 1p/1m signal to generate a set output. When the output signal of the AND circuit 39 appears according to the set output of the flip-flop circuit 37, a numerical value stored in the digit $D_1$ position of the shift memory unit 13 is [1], since the appearance of the output signal from the AND circuit 39 occurs after the 1p/m signal is generated i.e. one cycle after a step signal is delivered from the memory section 11*a* to the next higher memory section 11*b* in the shift register 11 to cause the contents of the memory section 11*a* to be cleared to zero. The digit $D_1$ position of the shift register 13 is preset to [2] by a signal from the AND circuit 39 to cause the shift cycle number of the shift register 13 to be cleared without allowing a next subsequent data entry and, i.e., to cause a carry to the memory section 11*b* at a substantially $(2^8-1)$ cycle. The flip-flop circuits 35 and 37 are reset at the digit $D_1$ timing to prohibit the above-mentioned cycle number correction operation until a 1p/m signal is generated from ROM 16. That is, a time counting operation is effected at a rate of $\{(2^8\times 60)-1\}$ per minute, such operation is repeated for each minute so long as a numerical value is present in the memory section $\alpha$. In this way, the cycle number corresponding to a correction number [x] written in the memory section $\alpha$ is subtracted until the value of the memory section $\alpha$ in the shift register 11 become zero. When the value of the memory section $\alpha$ become zero. When the value of the memory section $\alpha$ becomes zero, the correction value [x] is set to the memory section $\beta$. That is, the time count operation is effected at the above-mentioned cycle of $[\{(2^8\times 60)-1\}x+(2^8\times 60)\ (60-x)]$ over one hour in which the output of the binary counter is [0].

Next when a 1 p/h output signal is generated from ROM 16, the binary counter 31 is inverted to produce an output "1", which is in turn applied as a gate signal to the AND circuit 30. That is, the memory section $\beta$ of the shift register 11 is designated. Likewise, [1] is subtracted from a correction value "x" on the memory section $\beta$ for each minute and [1] is added to the contents of the memory section $\alpha$. When the above-mentioned subtraction and addition are so effected, the digit $D_1$ position of the shift memory unit 13 is preset to permit the contents of the cycle number memory section 11*a* in the shift register 11 to be counted one step irrespective of the data shift cycle of the shift register 11. That is, the cycle number x is subtracted from a preset value for each time unit of one hour. By so doing, an error caused between the standard frequency and the reference frequency of the reference oscillator 15 is corrected to assure a continuance of accurate time counting.

Figure 10:
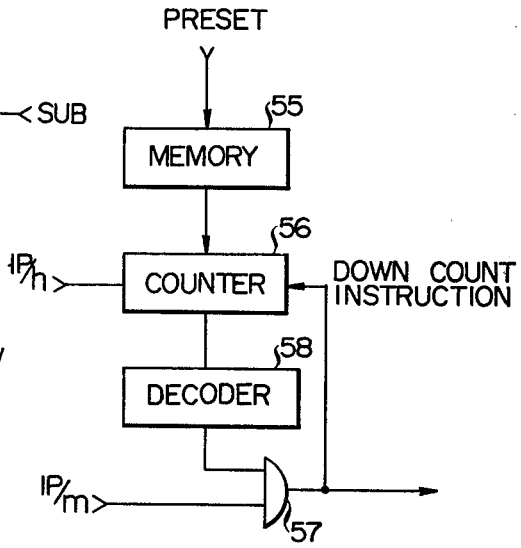
FIG. 10 shows a modified form of circuit for generating a correction instruction signal with respect to a correction value.

In the above-mentioned embodiment a correction cycle number x is set and, in order to cause [1] to be subtracted x times from the correction cycle number x at a rate of once per minute, two memory sections $\alpha$ and $\beta$ are provided in the shift register 11. In this case, the correction value x is always held in the memory sections $\alpha$ and $\beta$ by subtracting a correction value of either one of the memory sections $\alpha$ and $\beta$ during the above-mentioned cycle number subtraction operation and making a corresponding addition with respect to the other memory section. The correction value x may be stored in a memory device 55, as shown for example in FIG. 10, without using the shift register in particular. In this case, the correction value x is shifted to a counter 56 by a one-pulse per hour (1 p/h) signal and a preset correction instruction is given from an AND circuit 57 to the digit $D_1$ position of the cycle number memory section. The counter 56 is counted down each time the digit $D_1$ position of the cycle number memory section is preset for correction. In this way, the cycle number correction operation is effected x times, as in the atove-mentioned embodiment, at a rate of once per minute. 58 is a decoded for detecting the presence of a value on the counter 56.

In the above-mentioned embodiment the reference oscillator 15 is biased at the delay side and a time count operation is subjected to a corresponding fine adjustment by subtracting the specified cycle number of the shift register 11. However, this invention can also be put to practice by increasing the specified cycle number of the cycle number memory section 11*a* according to the correction value x. The cycle number correction control can also be effected either in a positive direction or in the negative direction by adding positive and negative discrimination elements to the correction value x.

Although in the above-mentioned embodiment the cycle number required to count one second i.e. a minimum time data of the memory section 11*b* in the shift register 11 is corrected, this invention is not restricted thereto. For example, a 1/10 second may be used as a minimum time limit. While in the above-mentioned embodiment the cycle number is corrected at a rate of one cycle per minute during the one hour period, this cycle may be arbitrarily set. For example, such an amount of correction may be set for each day. The cycle number correction may be made not only at a correction timing based on each minute, but at a timing as obtained by dividing a correction unit time according to an amount of correction x.

This invention is not restricted to the above-mentioned embodiment and may be changed in a variety of ways without departing from the spirit and scope of this invention.

What is claimed is:

1. An electronic timepiece comprising a reference oscillator; shift memory means adapted to be controlled in accordance with an oscillation signal from the reference oscillator and having a plurality of time count memory sections corresponding to an equal number of time count units and a cycle number memory section arranged such that it is preceded by the plurality of time count memory sections, said shift memory means being such that memory data can be sequentially shifted as a carry from the cycle number memory section toward the successive time count memory sections; means for adding to the contents of the cycle number memory section for each data shift cycle of the memory shift means; means for permitting the contents of a smallest time unit memory section of said memory sections to be counted one step when the count value of said cycle number memory reaction reaches a predetermined cycle number and for permitting a carry to the subsequent large time unit memory sections; write means for writing a correction value x corresponding to an error per a predetermined unit time as induced between a standard oscillation frequency and an oscillation frequency of said reference oscillator; setting means for setting x number of correction timings into which said predetermined unit time is divided; and means for correcting said predetermined cycle number counted in the cycle number memory section for each timing set by said setting means.

2. The electronic timepiece according to claim 1, in which said write means is set as first and second correction value memory sections in a predetermined area of said shift memory means, and comprises means for writing said correction value x in either one of said first and second correction value memory sections, means for designating a correction value stored in one of said first and second correction value memory sections for each predetermined unit time, means for substracting [1] from the contents in said correction valuestored memory section for each of said x number of timings until said correction value x becomes zero, and adding [1] to the other correction value memory section, and means for correcting said predetermined value in said cycle number memory section each time such subtraction and addition are effected with respect to said one and other memory sections.

3. The electronic timepiece according to claim 1, in which said write means is adapted to write data in a different memory means from said shift memory means and comprises means for transmitting the correction value x from said different memory means to a time count circuit for each unit time, means for subtracting the correction value x transferred to said time count circuit, and means for correcting the cycle number as counted at the cycle number memory section for each correction timing.

4. The electronic timepiece according to claim 1, in which said shift memory means is constructed of a dynamic shift register.

5. The electronic timepiece according to claim 2, in which said shift memory means is constructed of a dynamic shift register.

6. The electronic timepiece according to claim 3, in which said shift memory means is constructed of a dynamic shift register.

* * * * *